US007443363B2

(12) United States Patent
Ying

(10) Patent No.: US 7,443,363 B2
(45) Date of Patent: Oct. 28, 2008

(54) COMPACT DIELECTRIC RESONATOR ANTENNA

(75) Inventor: Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 38 days.

(21) Appl. No.: 11/534,480

(22) Filed: Sep. 22, 2006

(65) Prior Publication Data

US 2008/0122703 A1 May 29, 2008

Related U.S. Application Data

(60) Provisional application No. 60/805,536, filed on Jun. 22, 2006.

(51) Int. Cl.

| | |
|---|---|
| ***H01Q 15/02*** | (2006.01) |
| ***H01Q 15/08*** | (2006.01) |
| ***H01Q 19/06*** | (2006.01) |
| ***H01Q 1/38*** | (2006.01) |
| ***H01Q 1/24*** | (2006.01) |
| ***H01P 1/20*** | (2006.01) |

(52) U.S. Cl. ..... 343/911 R; 343/702; 343/700 MS; 333/202

(58) Field of Classification Search ..... 343/702, 343/911 R, 825, 826, 785; 333/202
See application file for complete search history.

(56) References Cited

U.S. PATENT DOCUMENTS

| | | | | |
|---|---|---|---|---|
| 6,545,642 | B1 * | 4/2003 | Doub et al. | 343/702 |
| 6,762,658 | B1 * | 7/2004 | Isomura et al. | 333/202 |
| 2002/0036596 | A1 | 3/2002 | Noro | |
| 2004/0155817 | A1 | 8/2004 | Kingsley | |
| 2004/0233107 | A1 * | 11/2004 | Popov et al. | 343/700 MS |
| 2005/0017903 | A1 * | 1/2005 | Ittipiboon et al. | 343/700 MS |
| 2006/0232474 | A1 * | 10/2006 | Fox | 343/700 MS |

FOREIGN PATENT DOCUMENTS

| | | |
|---|---|---|
| EP | 1531516 A1 * | 5/2005 |
| GB | 1 555 754 | 11/1979 |
| GB | 2 355 855 | 5/2001 |
| WO | 0014826 | 3/2000 |

OTHER PUBLICATIONS

Ratner, et al., "Neural network simulation of a dielectric ring resonator antenna", Journal of Systems Architecture, vol. 44, No. 8 (Apr. 1998) pp. 569-581.
PCT Search Report and Written Opinion, Mar. 14, 2007, 10 pages.

* cited by examiner

*Primary Examiner*—Michael C. Wimer
*Assistant Examiner*—Marlon Browne
(74) *Attorney, Agent, or Firm*—Harrity & Harrity, LLP

(57) ABSTRACT

A dielectric radiator antenna arrangement for a communication device having a ground plane is provided. The antenna arrangement may include a dielectric volume having a central axis normal to the ground plane, and mode-exciting elements. The mode-exciting elements may include a first mode-exciting element provided in or attached to the dielectric volume and extending in a plane provided at a first distance from the central axis perpendicular to the ground plane, and a second mode-exciting element provided in or attached to the dielectric volume and extending in a plane provided at a second distance from the central axis and perpendicular to both the ground plane and the plane of the first mode-exciting element. The antenna arrangement can be used for simultaneously transmitting and receiving more than one signal at one frequency with reduced coupling.

16 Claims, 3 Drawing Sheets

COMPACT DIELECTRIC RESONATOR ANTENNA

RELATED APPLICATIONS

This application claims priority under 35 U.S.C. § 119 based on U.S. Provisional Application Ser. No. 60/805,536, filed Jun. 22, 2006, the disclosure of which is incorporated herein by reference.

TECHNICAL FIELD OF THE INVENTION

The present invention relates to the field of antennas and more particularly, to a dielectric resonator antenna arrangement, as well as a portable communication device including such an antenna arrangement.

DESCRIPTION OF RELATED ART

MIMO (multiple input, multiple output) is an antenna technology for wireless communications in which multiple antennas are used at both the source (transmitter) and the destination (receiver). The antennas at each end of the communications circuit are combined to minimize errors and optimize data speed. MIMO-based antennas are of interest in relation to communication such as digital TV, WLAN, and in mobile communications. MIMO arrangements are of particular interest for use in wireless communication, such as in portable communication devices, for instance cellular phones.

However, the size of a cellular phone is preferably small, and it is therefore disadvantageous to include more than one antenna in such a device. This becomes even more of a factor as cellular phones need to communicate in different types of systems. This means that if the MIMO concept is used for a small portable communication device, it may be difficult to provide antennas in the device that have a low incidence of coupling to each other, especially if the device is to be kept small.

In recent years, a new type of antenna has evolved that is small and has a high radiation efficiency, and is therefore of interest for use in cellular phones. In a dielectric resonator antenna, a probe can excite a transmission mode in a resonating dielectric antenna volume.

US 2004/0155817 describes a multi-polarization dielectric resonator antenna having three mutually orthogonal feeds, where the feeds extend radially from a central axis of the volume. These feeds have polarizations at 120 degrees to each other and therefore allow the transmission and/or reception of signals in three polarizations, simultaneously.

However, when applying a dielectric resonator antenna type in a MIMO system and using it for the transmission of two or more signals using the same frequency, a high coupling often occurs between the different antenna signals. The occurrence of the coupling may seriously degrade the performance of such an antenna.

It would therefore be beneficial to provide a dielectric resonator antenna that can be used for simultaneously transmitting and receiving more than one signal at the same frequency and where the incidence of coupling between these antenna signals is reduced.

SUMMARY OF THE INVENTION

The present invention is generally directed to providing a dielectric resonator antenna arrangement that can be used for simultaneously transmitting and receiving more than one signal at the same frequency and where the incidence of coupling between the antenna signals is reduced.

Implementations consistent with the principles of the present invention provide a dielectric resonator antenna arrangement that can be used for simultaneously transmitting and receiving more than one signal at the same frequency and where the incidence of coupling between these antenna signals is reduced.

According to one aspect, a dielectric resonator antenna arrangement may be provided on a ground plane and may include a dielectric volume having an axis substantially in the center of the volume provided as a normal to the ground plane, and a number of mode-exciting elements including, a first mode-exciting element provided in or attached to the dielectric volume and extending in a plane provided at a first distance from the central axis and being perpendicular to the ground plane, and a second mode-exciting element provided in or attached to the dielectric volume and extending in a plane provided at a second distance from the central axis and being perpendicular to both the ground plane and the plane of the first mode-exciting element.

Additionally, an antenna arrangement may include the features of the first aspect, wherein the first and second distances are equal.

Additionally, an antenna arrangement may include the features of the first aspect, wherein the first and second mode-exciting elements are provided adjacent the ground plane.

Additionally, an antenna arrangement may include the features of the first aspect, further including a third mode-exciting element in the center of the dielectric volume normal to the ground plane.

Additionally, the third mode-exciting element may extend from a bottom surface of the dielectric volume that is parallel to and faces the ground plane.

Additionally, an antenna arrangement may include the features of the first aspect, wherein at least one mode-exciting element is a capacitively fed slot.

Additionally, an antenna arrangement may include the features of the first aspect, wherein the volume includes more than one dielectric material with different dielectric constants, where the materials are provided in a direction from the central axis and outwards and each outer material completely surrounds an inner material.

Additionally, an antenna arrangement may include the features of the first aspect, wherein the dielectric volume is cubical.

In other implementations consistent with the principles of the present invention is to provide a communication device that includes a dielectric resonator antenna arrangement, which can be used for simultaneously transmitting and receiving more than one signal at the same frequency and where the incidence of coupling between these antenna signals is reduced.

According to a another aspect, a communication device may comprise a ground plane, a dielectric resonator antenna arrangement including a dielectric volume having a central axis normal to the ground plane, and a number of mode-exciting elements including, a first mode-exciting element provided in or attached to the dielectric volume and extending in a plane provided at a first distance from the central axis and being perpendicular to the ground plane, a second mode-exciting element provided in or attached to the dielectric volume and extending in a plane provided at a second distance from the central axis and being perpendicular to both the ground plane and the plane of the first mode-exciting element, and a separate signal feeder for each mode-exciting element.

Additionally, a communication device may include a portable communication device.

Additionally, a communication device may include a cellular phone.

Implementations may provide radiation patterns associated with different modes that are orthogonal to each other. Also the polarizations may be orthogonal. Because of this, there may result a low correlation or coupling between the modes together with a high efficiency, which enables them to be used simultaneously for the same frequency, for instance in MIMO applications. The antenna arrangement may be provided as a single component, which may be a surface mount component. The component may be very small and does thus not occupy much space within a communication device. Such a component may be easily mass-produced and therefore allow the provision of an inexpensive antenna arrangement. The component may be readily mounted on a circuit board It should be emphasized that the term "comprises/comprising," when used in this specification, is taken to specify the presence of stated features, integers, steps, or components, but does not preclude the presence or addition of one or more other features, integers, steps, components, or groups thereof.

BRIEF DESCRIPTION OF THE DRAWINGS

The present invention will now be described in more detail in relation to the enclosed drawings, in which.

DETAILED DESCRIPTION OF EMBODIMENTS

Figure 1:
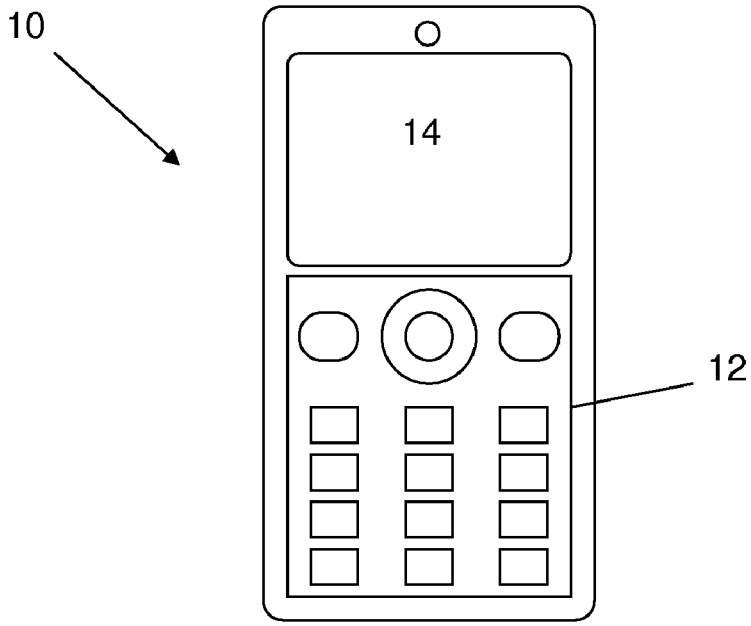
FIG. 1 shows a front view of a portable communication device in the form of a cellular phone FIG. 2 schematically shows a side view of a dielectric resonator antenna arrangement, according to one implementation, provided above a circuit board including a ground plane

FIG. 1 shows a front view of a (portable) communication device 10, for example, in the form a cellular phone. The various functional units of communication device 10 may be provided inside a housing that may be provided with openings through which a display 14 and a keypad 12 may be provided. Communication device 10 may include at least one antenna arrangement, which, according to an implementation consistent with the principles of the invention, may be provided in the housing of communication device 10. A phone is just one type of portable communication device. Other examples are PDAs (Personal Digital Assistants) and laptop computers. The invention is furthermore not limited to portable communication devices, but may be used in stationary communication devices, for instance, in base stations.

Figure 2:
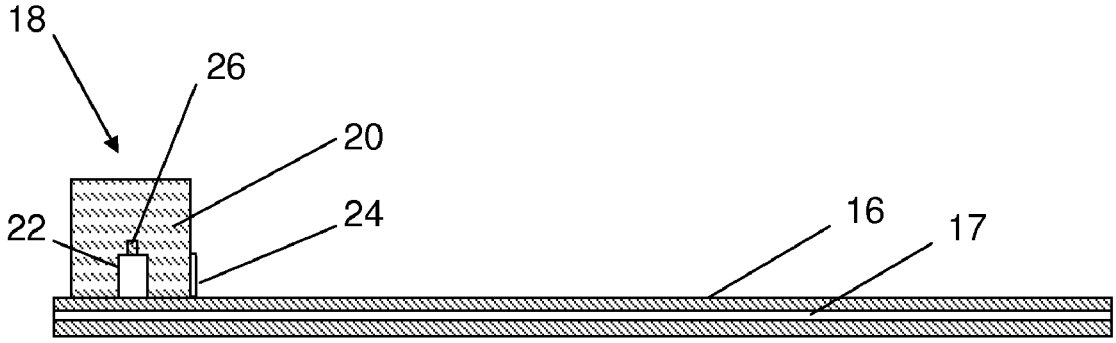

FIG. 2 shows a side view of an antenna arrangement 18, according to one implementation, provided on a (circuit) board 16 including a ground plane 17. On board 16, a radio circuit (not shown) may be arranged to feed antenna arrangement 18 with a number of (radio frequency) signals, for example, three signals. The signals may have the same frequency. Antenna arrangement 18 may be configured to also receive three signals that may have the same frequency and forward these to the radio circuit for further processing. As such, antenna arrangement 18 may be provided for a MIMO-type system.

Antenna arrangement 18 may be a dielectric resonator antenna and therefore, may take the shape of a defined volume, at least partially filled with a dielectric material 20. The volume may thus be characterized as a dielectric volume, shown here as a cube. The shape of the volume may be dimensioned for resonating at the above-mentioned frequency and with at least two different modes, for example, a TEM mode and in a HEM mode. Other modes are possible. Antenna arrangement 18 may include mode-exciting elements 22, 24, 26 that may be arranged to excite, for example, three modes within the cube.

Figure 3:
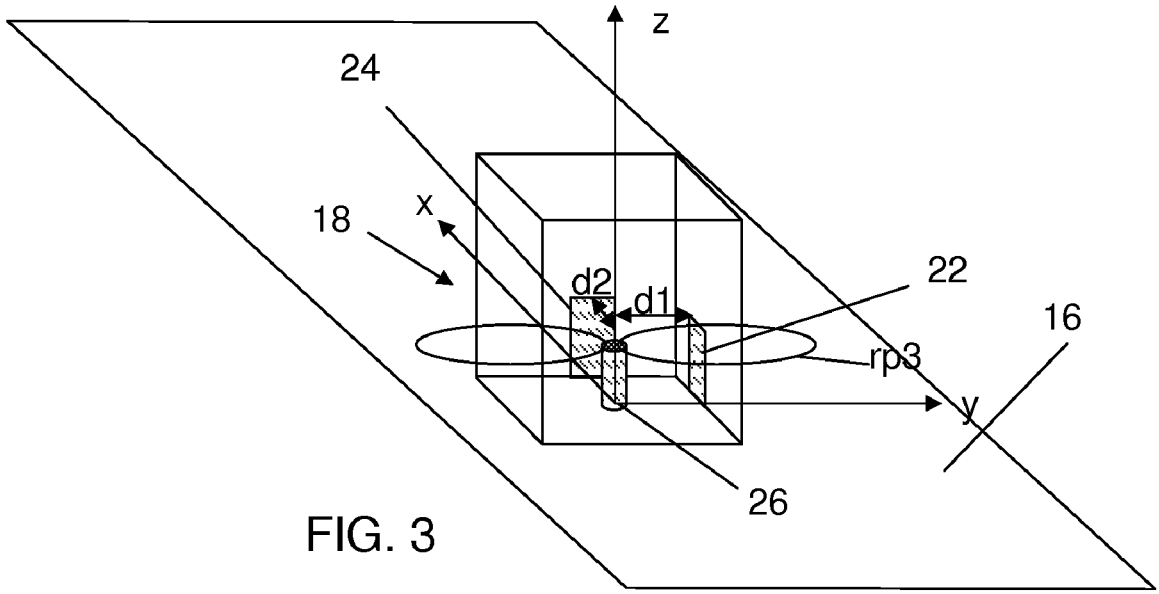
FIG. 3 shows a perspective view of the dielectric resonator antenna arrangement, according to one implementation, provided above the ground plane
Figure 4:
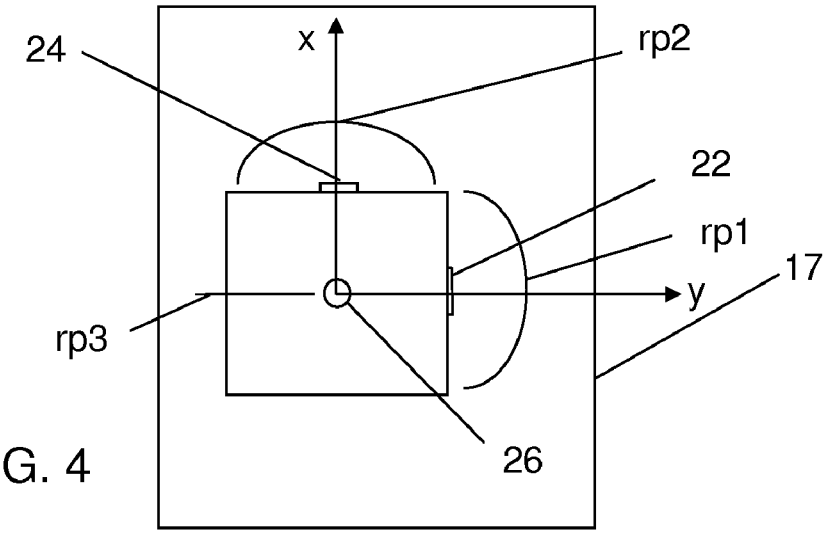
FIG. 4 shows a view from above of the dielectric resonator antenna arrangement according to the present invention provided above the ground plane FIG. 5 schematically shows capacitive feeding of a mode-exciting element in the dielectric resonator antenna arrangement, according to one implementation.

One implementation is shown in more detail in a perspective view in FIG. 3, and also in a plan view in FIG. 4. In relation to the cube, there is shown a three-dimensional coordinate system, with x-, y- and z-axes, where the z-axis goes upwards from the middle of the cube at a bottom side of this cube that faces ground plane 17. The z-axis is thus a normal of ground plane 17 and in this way, may define a central axis of the cube. The x-axis starts from the same point in the middle of the cube and continues in the middle between a right and a left bottom side of the cube and in parallel with these sides in a direction towards a far short side of ground plane 17 and thereby crosses a far bottom side of the cube at right angles. The y-axis starts from the same point in the middle of the cube in the middle and continues between a front bottom side and a back bottom side of the cube and in parallel with these sides in a direction towards a right long side of ground plane 27 and thereby crosses the right bottom side of the cube at right angles. First mode-exciting element 22, may be in the form of a rectangular probe and provided in a plane parallel to the xz-plane at a distance d1 from the central axis z and on a right vertical side of the cube at a bottom side thereof. The plane that first mode-exciting element 22 is provided in may also be perpendicular to ground plane 17. Second mode-exciting element 24, may be in the form of a rectangular probe, and provided in a plane parallel to the xy-plane at a distance d2 from the central axis and on a far vertical side of the cube at a bottom side thereof. The plane that second mode-exciting element 24 is provided in may be perpendicular to ground plane 17 and also to the plane in which first mode-exciting element 22 may be provided. First and second mode-exciting elements 22, 24 may be provided adjacent ground plane 17. Third mode-exciting element 26 may be in the form of a pin, and may extend from the bottom side of the cube that faces ground plane 17 and along the z-axis, i.e. along the central axis. Each mode-exciting element 22, 24, 26 may be connected to a separate signal feeder (not shown) of communication device 10 to receive a separate signal.

This exemplary placing of first mode-exciting element 22 may excite a HEM mode of the electrical field of the cube, which field may provide a first radiation pattern rp1 that may be semi-spherical and provided symmetrically around the y-axis in a plane parallel to or within the xy-plane and having a horizontal extension. Second mode-exciting element 24 may also excite a HEM mode of the electrical field of the cube, which field may provide a second radiation pattern rp2 that may be semi-spherical and provided symmetrically around the x-axis in a plane parallel to or within the xy-plane and also having a horizontal extension. Third mode-exciting element 26 may provide a third radiation pattern rp3 that may be a vertical omni directional pattern provided in the yz-plane.

With this exemplary placing of mode-exciting elements 22, 24, 26, radiation patterns rp1, rp2 and rp3 that are orthogonal to each other may be provided. Also, the polarizations may be orthogonal. There may furthermore a low correlation or coupling between the modes together with a high efficiency, which enables them to be used simultaneously for the same frequency in MIMO applications.

Figure 5:
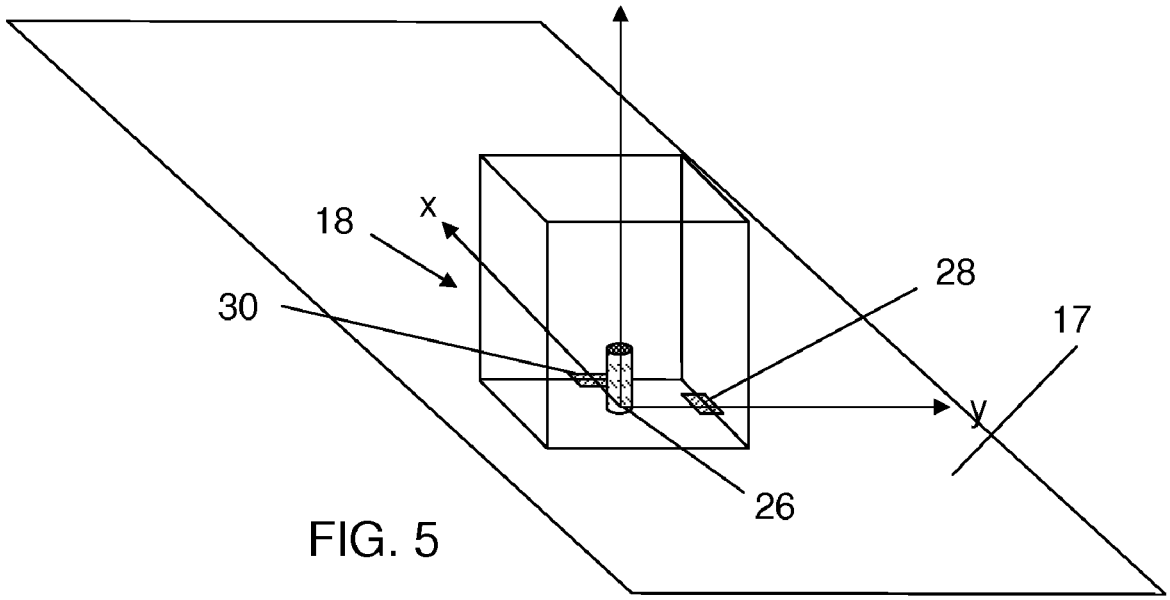

A number of variations may be made to antenna arrangement 18. For example, first and second distances d1 and d2 may be equal. Alternatively, first and second distances d1 and d2 may differ from each other, while remaining orthogonal to each other. First and second distances d1 and d2 may be provided at the same distance above ground plane 17, or may be provided at different distances to ground plane 17. First and second mode-exciting elements 22, 24 may also be provided further away from ground plane 17. As shown, each mode-exciting element is also directly fed by a radio signal from the radio circuit. Alternatively, it is also possible that either first mode-exciting element 22 or second mode-exciting element 24 or both first and second mode-exciting elements 22, 24 may be provided as slots 28 and 30 in circuit board 16. Such a slot may then be capacitively fed for exciting a HEM mode in the cube. This is schematically shown in FIG. 5, which in all other respects include the same elements as FIG. 3.

Figure 6:
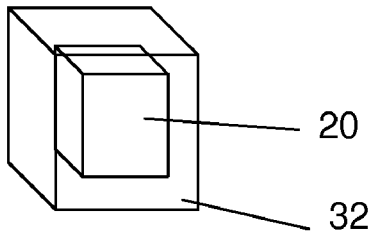
FIG. 6 schematically shows a dielectric volume comprising materials having different dielectric constants.

It is furthermore possible to provide the volume with more than one dielectric material, where the dielectric constant of the materials may differ. Therefore, a first dielectric material 20 may be substantially surrounded by a second material 32, where the materials are concentrically provided outwards from the central axis. This is generally shown in a perspective view in FIG. 6. In this implementation, possible to provide different materials may be used for the dielectric volume.

In the described implementation, the volume was provided in the form of a cube. It should be realized that the invention is in no way limited to a cube or any other particular shape. The volume may be spherical, hemispherical, cylindrical, half-cylindrical, circular, half-circular, have pyramid shape or combinations of these shapes. The volume may be any type of regular or irregular shape. The mode-exciting elements have been described as provided on the outer side of the dielectric material; however, the mode-exciting elements may be provided inside the material as well, at a distance from the central axis and, for example, orthogonal to one another. The mode-exciting elements may then be provided in cavities provided in the dielectric material, for example. Other configurations are possible.

The mode-exciting elements may be provided by printing or painting metal, for example, on the dielectric material or by inserting metal elements in drilled holes in the dielectric material. Accordingly, it is furthermore possible to provide antenna arrangement as a single component, which may be a surface mount component. The component may be very small and thus may occupy limited space within a portable communication device. Such a component may be easily mass-produced and thus permits the provision of an inexpensive antenna arrangement. Since it is a component, it may be readily mounted to a circuit board, for example, or any other substrate.

What is claimed is:

1. A dielectric resonator antenna arrangement to be provided on a ground plane, comprising:

a dielectric volume having a central axis normal to the ground plane; and at least three mode-exciting elements, including, a first mode-exciting element provided in or attached to the dielectric volume and extending in a plane provided at a first distance from the central axis and being perpendicular to the ground plane, a second mode-exciting element provided in or attached to the dielectric volume and extending in a plane provided at a second distance from the central axis and being perpendicular to both the ground plane and the plane of the first mode-exciting element, and a third mode-exciting element centrally disposed in the dielectric volume extending along the central axis in a direction normal to the ground plane, wherein each of the mode-exciting elements connects to a separate signal feeder.

2. The antenna arrangement of claim 1, wherein the first and second distances are equal.

3. The antenna arrangement of claim 1, wherein the first and second mode-exciting elements are provided adjacent the ground plane.

4. The antenna arrangement of claim 1, wherein the third mode-exciting element extends from a surface of the dielectric volume adjacent the ground plane.

5. The antenna arrangement of claim 1, wherein at least one mode-exciting element is a capacitively fed slot.

6. The antenna arrangement of claim 1, wherein the volume comprises a plurality of dielectric materials having different dielectric constants, wherein the dielectric materials are provided concentrically about the central axis and an outer one of the dielectric materials completely surrounds an inner one of the dielectric materials.

7. The antenna arrangement according to claim 1, wherein the dielectric volume is cubical.

8. A communication device comprising:

a ground plane;

a dielectric resonator antenna arrangement including:

a dielectric volume having a central axis normal to the ground plane, and a number of mode-exciting elements, including, a first mode-exciting element provided in or attached to the dielectric volume and extending in a plane provided at a first distance from the central axis and being perpendicular to the ground plane, a second mode-exciting element provided in or attached to the dielectric volume and extending in a plane provided at a second distance from the central axis and being perpendicular to both the ground plane and the plane of the first mode-exciting element, and a third mode-exciting element centrally disposed in the dielectric volume extending along the central axis in a direction normal to the ground plane; and a separate signal feeder for each mode-exciting element.

9. The communication device of claim 8, wherein the communication device comprises a portable communication device.

10. The communication device of claim 9, wherein the communication device comprises a cellular phone.

11. The communication device of claim 8, wherein the third mode-exciting element is entirely within the dielectric volume.

12. The communication device of claim 8, wherein the first and second distances differ.

13. The communication device of claim 8, wherein a height of the first mode-exciting element differs from a height of the second mode-exciting element.

14. The antenna arrangement of claim 1, wherein the third mode-exciting element is entirely within the dielectric volume.

15. The antenna arrangement of claim 1, wherein the first and second distances differ.

16. The antenna arrangement of claim 1, wherein a height of the first mode-exciting element differs from a height of the second mode-exciting element.

* * * * *